US007171727B2

(12) United States Patent
Wylie et al.

(10) Patent No.: US 7,171,727 B2
(45) Date of Patent: Feb. 6, 2007

(54) METHOD AND APPARATUS FOR APPLIANCE CONTROL AND STATUS DISPLAY

(75) Inventors: Brian D. Wylie, Verona, WI (US); Mark Straub, Janesville, WI (US); Shawn O. Barrett, Des Plaines, IL (US); Curtis L. Cruver, IV, Elmhurst, IL (US); Raymond Bambule, Naperville, IL (US); Jim Johncock, Shelbyville, MI (US); Todd Kercher, Holland, MI (US)

(73) Assignee: Wolf Appliance Company, Inc., Fitchburg, WI (US)

( * ) Notice: Subject to any disclaimer, the term of this patent is extended or adjusted under 35 U.S.C. 154(b) by 432 days.

(21) Appl. No.: 10/265,219

(22) Filed: Oct. 4, 2002

(65) Prior Publication Data

US 2004/0070574 A1 Apr. 15, 2004

(51) Int. Cl.
*A45C 3/00* (2006.01)
*H01H 9/00* (2006.01)

(52) U.S. Cl. ..... 16/441; 200/316; 345/156

(58) Field of Classification Search ..... 345/156, 345/184, 82–83; 200/314, 315, 316; 16/121, 16/441; 74/435; 219/453; 126/39 R, 39 E, 126/39 N See application file for complete search history.

(56) References Cited

U.S. PATENT DOCUMENTS

| | | | | |
|---|---|---|---|---|
| 4,778,966 | A | 10/1988 | Obata et al. | |
| 5,133,265 | A | 7/1992 | Lahti et al. | |
| 5,259,267 | A | 11/1993 | Jurewicz | |
| 5,283,432 | A | 2/1994 | McKillip | |
| 5,294,047 | A * | 3/1994 | Schwer et al. | 236/46 R |
| D346,406 | S | 4/1994 | Pennington | |
| D347,920 | S | 6/1994 | Sell | |
| 5,450,653 | A | 9/1995 | Howie, Jr. | |
| 5,509,174 | A | 4/1996 | Worrell | |
| 5,669,104 | A | 9/1997 | Howie, Jr. | |
| 5,764,391 | A | 6/1998 | Smith | |
| 5,845,365 | A | 12/1998 | Howie, Jr. | |
| 5,865,302 | A | 2/1999 | Suzuki et al. | |
| 5,912,663 | A | 6/1999 | Cheng | |
| 6,003,206 | A | 12/1999 | Hall et al. | |
| 6,034,336 | A | 3/2000 | Lee | |
| 6,104,007 | A * | 8/2000 | Lerner | 219/445.1 |
| 6,111,240 | A * | 8/2000 | Kishimoto et al. | 219/720 |
| 6,136,248 | A | 10/2000 | Howie, Jr. | |
| 6,154,201 | A | 11/2000 | Levin et al. | |
| 6,178,916 | B1 | 1/2001 | Snider | |
| 6,227,068 | B1 * | 5/2001 | Masui et al. | 74/473.3 |
| 6,229,456 | B1 | 5/2001 | Engholm et al. | |

(Continued)

FOREIGN PATENT DOCUMENTS

JP 10132284 * 5/1998

*Primary Examiner*—Amr A. Awad
(74) *Attorney, Agent, or Firm*—Foley & Lardner LLP

(57) ABSTRACT

A method and apparatus for an appliance control knob incorporating a microprocessor and a status display built into the control knob housing. Such a control knob gives the appliance a clean and uncluttered appearance, and allows a user of the appliance both to control the appliance, for example by adjusting the oven temperature setpoint, and to be informed of the status of the appliance, for example the actual oven temperature, in a way that is easy to understand and to use.

29 Claims, 8 Drawing Sheets

U.S. PATENT DOCUMENTS

RE37,687 E 5/2002 Howie, Jr.
6,391,243 B1 5/2002 Howie, Jr.
D462,913 S 9/2002 Brisbee
6,564,661 B2 * 5/2003 DeJonge ..... 74/335
2003/0154970 A1 * 8/2003 Huang ..... 126/39 R

* cited by examiner

METHOD AND APPARATUS FOR APPLIANCE CONTROL AND STATUS DISPLAY

FIELD OF THE INVENTION

The present invention relates generally to the field of appliances, and particularly to status displays and operating controls used on appliances.

BACKGROUND OF THE INVENTION

Professional and high end domestic appliances have become increasingly sophisticated in function and appearance in response to evolving consumer tastes and needs.

Appliances, particularly appliances which include digital control systems, may incorporate complicated status displays and operating controls to support sophisticated functionality. However such displays and controls are often perceived as complicated, non-intuitive, and visually unattractive. It can be difficult to design an appliance that provides the controls and status displays needed to support sophisticated functionality along with a clean, uncluttered appearance.

Usability and ergonomics also play an important role in consumer purchasing decisions. For example, an appliance design which places a display of actual oven temperature directly adjacent to the knob which controls the oven temperature setpoint may make an appliance easier to operate and understand.

For these reasons, a method and apparatus including a control knob with a built in status display would appeal to consumers and increase sales of appliances which incorporate the method and apparatus.

SUMMARY OF THE INVENTION

The present invention relates to a method and apparatus which includes an appliance control knob incorporating a microprocessor and a status display built into the control knob housing. According to another aspect of the invention, the appliance control knob incorporates a bipolar connector which serves both as an axle for rotation of the control knob, and as an electrical connector for transmission of both data and power to the control knob.

Such a control knob allows a user of the appliance both to control the appliance, for example by adjusting the oven temperature setpoint, and to be informed of the status of the appliance, for example the actual oven temperature, in a way that is easy to understand and to use. Such a control knob can display appliance status information that would otherwise require a separate display unit, making the appearance of the appliance cleaner and more appealing.

Such a control knob may be formed as a separate sealed component which plugs into a socket, allowing the control knob to be easily removed and replaced, for example for maintenance, repair, or cleaning of the knob and appliance.

A appliance control knob according to the invention may include a second control surface, to form a composite control knob assembly. For example, such a composite control knob assembly may provide an outside rotating bezel to set the oven cooking mode (e.g. bake, broil, or convection) with an inner control knob according to the invention used to adjust oven temperature setpoint and display actual oven temperature.

Further objects, features, and advantages of the invention will be apparent from the following detailed description when taken in conjunction with the following drawings.

DETAILED DESCRIPTION OF THE INVENTION

Figure 1:
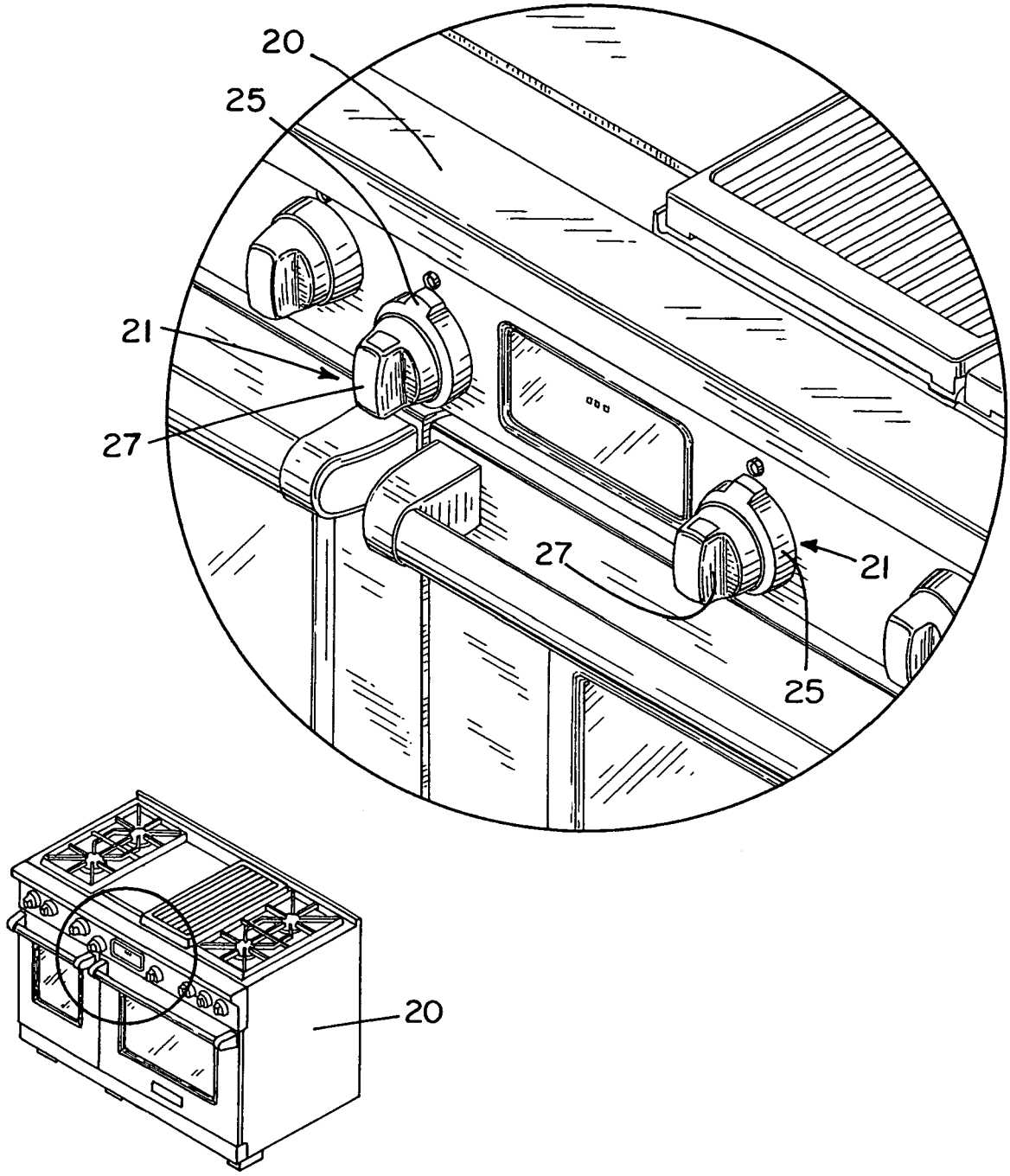
FIG. 1 is a perspective view of an appliance incorporating a preferred embodiment of a composite control knob assembly according to the invention.

With reference to the drawings, the lower left portion of FIG. 1 shows a perspective view of an appliance, indicated generally at 20. The upper portion of FIG. 1 shows a close-up view of the controls for the appliance, including a preferred embodiment of a composite control knob assembly according to the invention indicated generally at 21, comprised of a control knob according to the invention indicated generally at 27 and an optional second control surface indicated generally at 25.

Figure 2:
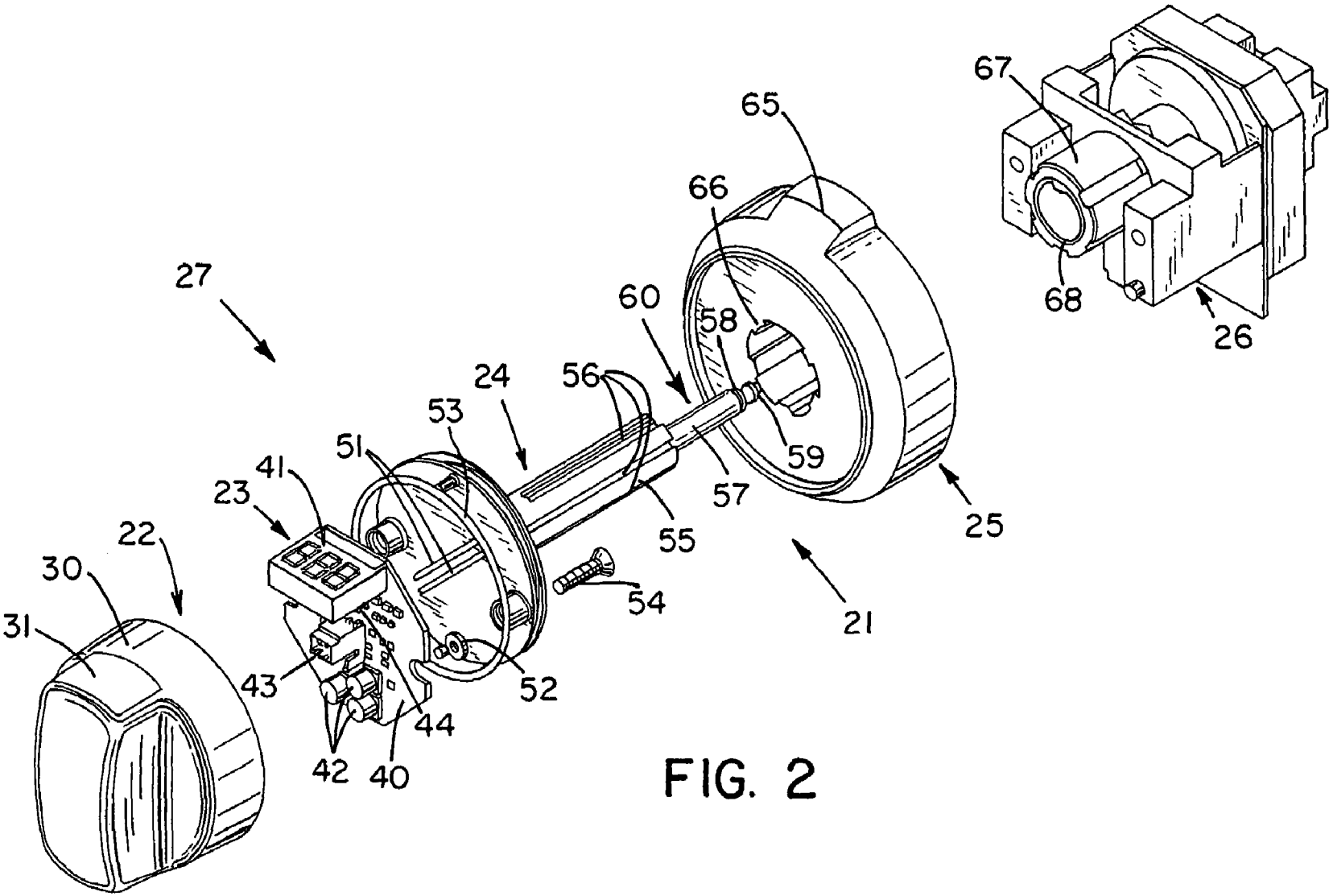
FIG. 2 is an exploded view of a preferred embodiment of a composite control knob assembly according to the invention.
Figure 3:
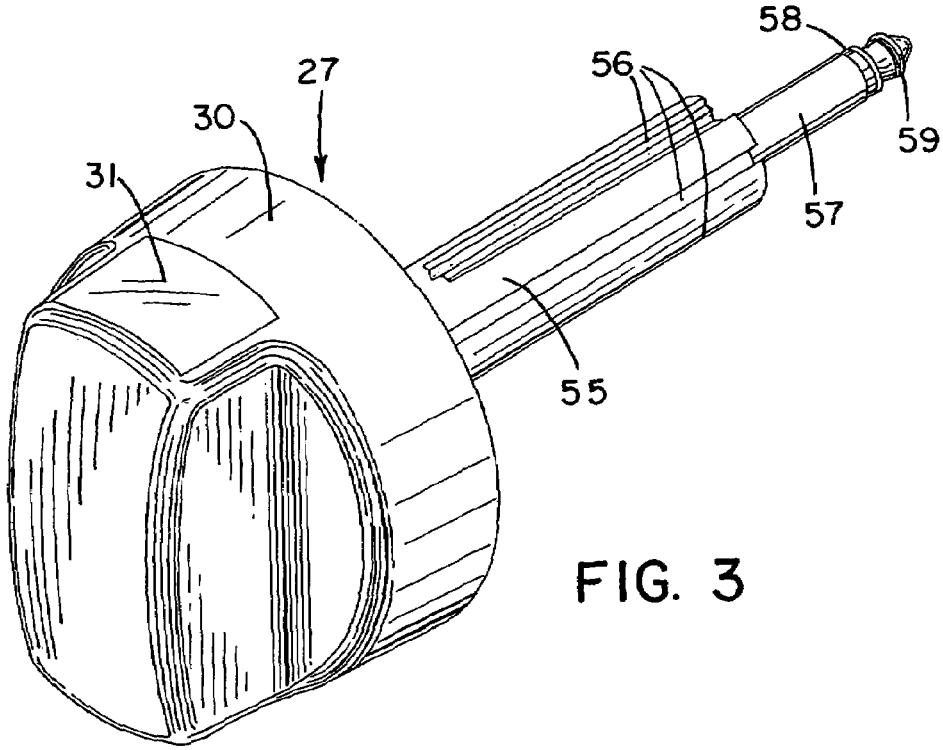
FIG. 3 is a perspective view of a preferred embodiment of a control knob according to the invention.
Figure 4:
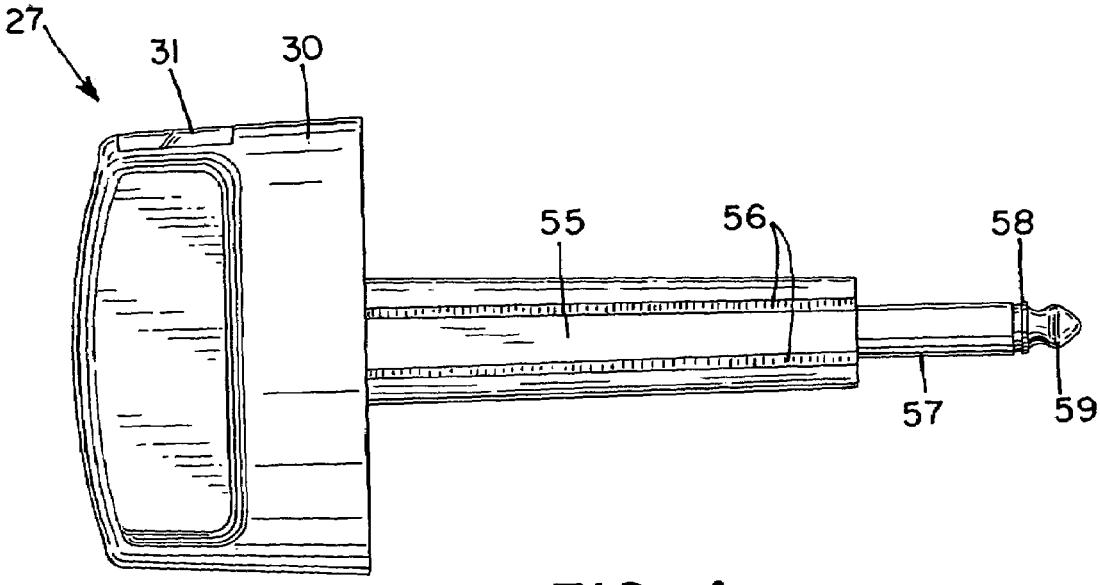
FIG. 4 is a side view of a preferred embodiment of a control knob according to the invention.
Figure 5:
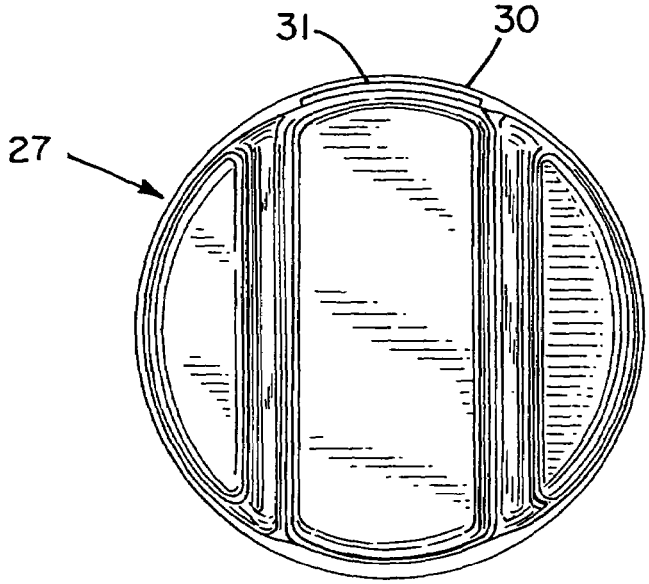
FIG. 5 is a front view of a preferred embodiment of a control knob according to the invention.
Figure 6:
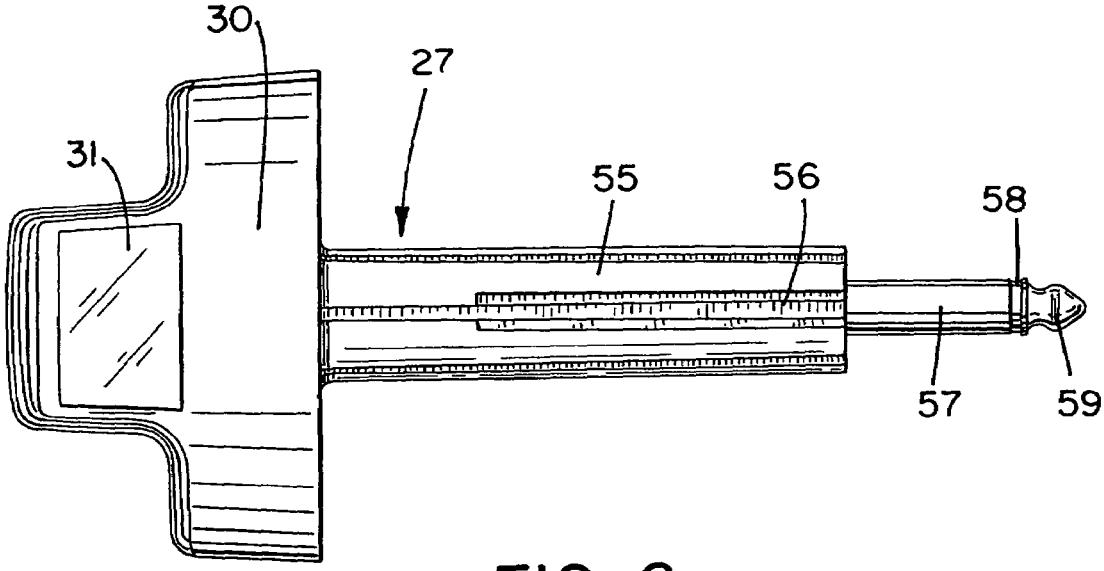
FIG. 6 is a top view of a preferred embodiment of a control knob according to the invention.

As shown in the exploded FIG. 2, a preferred embodiment of a control knob according to the invention, indicated generally at 27, may include a knob housing 22, a digital electronic circuit 23, and a shaft assembly 24. The control knob 27 may optionally include a second control surface 25 to form a composite control knob assembly 21. The control knob 27, and optional second control surface 25 may be plugged into a socket 26.

As shown in FIG. 2, a preferred embodiment of a control knob according to the invention may include a knob housing, indicated generally at 22, having a knob visible surface 30 and a knob display window 31, which are normally visible to the user of the appliance. The shape of the knob housing 22 is preferably ergonomically designed, for example by including a rib for ease of turning. The knob display window 31 is preferably formed of, or is coated with, a material or surface protectant which is resistant to cleaning chemicals, foods, and scratching. The color of the knob display window 31 may be chosen to reduce the visibility of the knob display window 31 when the display is off, for example when the knob is not in use or the appliance is off.

In a preferred embodiment, the rotation of the control knob 27 may be limited, for example to plus or minus 15 degrees, so the display on the knob is never hidden by the rotation. The rotation of the control knob 27 may also be spring-loaded so that the control knob 27 returns to its nominal centered position after adjustment.

As shown in FIG. 2, a preferred embodiment of a control knob according to the invention includes a digital electronic circuit, indicated generally at 23. The digital electronic circuit 23 includes a display 41, which is preferably a light emitting diode (LED) or equivalent, such as a liquid crystal display or other electronic display, and a microprocessor 44 or equivalent, such as a microcontroller, programmable logic device, or other digital electronic circuit. In a preferred embodiment, the digital electronic circuit 23 may be constructed using a printed circuit board 40, one or more capacitors 42, and a bipolar connector socket 43 to provide an electrical connection between the digital electronic circuit 23 and the shaft assembly 24.

As shown in FIG. 2, a preferred embodiment of a control knob according to the invention may include a shaft assembly, indicated generally at 24. The shaft assembly 24 may include a shaft housing 55, preferably made of plastic or other insulating material. The shaft housing 55 and the knob housing 22 may be fastened together, for example using washers 52, an O-ring 53, and screws 54, to form a sealed cavity which encloses the electronic circuit 23 and protects the electronic circuit 23 from grease and other kitchen materials which may cause the control knob to malfunction or to become unsanitary.

The shaft assembly 24 includes a bipolar connector, indicated generally at 60, which is preferably a standard ¼" phone plug having a sleeve 57, an insulator 58, and a tip 59. The sleeve 57 and the tip 59 of the bipolar connector 60 are each connected electrically to one of the bipolar connector to circuit board plugs 51, which may be plugged into the bipolar connector socket 43 on the digital electronic circuit 23.

As shown in FIG. 2, a preferred embodiment of a composite control knob assembly according to the invention may include a second control surface 25. The second control surface 25 may be formed in the shape of a ring, and may have at least one position indicator 65. The second control surface 25 may also have at least one actuator 66.

The bipolar connector 60 may be plugged into a socket, indicated generally at 26. The socket 26 may have a shaft assembly receiver 68, to mate with the shaft assembly 24. The shaft assembly 24 may bear key slots 56, for example to ensure that the shaft assembly 24 can only be inserted into the socket 26 in one way. The socket 26 may convert rotation of the shaft assembly 24 into a signal, for example an analog resistance or capacitance value or a digital coded value, which may be transmitted to the control system for the appliance (not shown). Presence of the bipolar connector 60 in the socket 26 may be monitored by the control system for the appliance (not shown), so that the appliance may be automatically shut down if the control knob 27 is removed.

The socket 26 may also have a second control surface receiver 67 which mates with the second control surface actuator 66. The socket 26 may convert rotation of the second control surface into a signal, for example an analog resistance or capacitance value or a digital coded value, which may be transmitted to the control system for the appliance (not shown).

Figure 7:
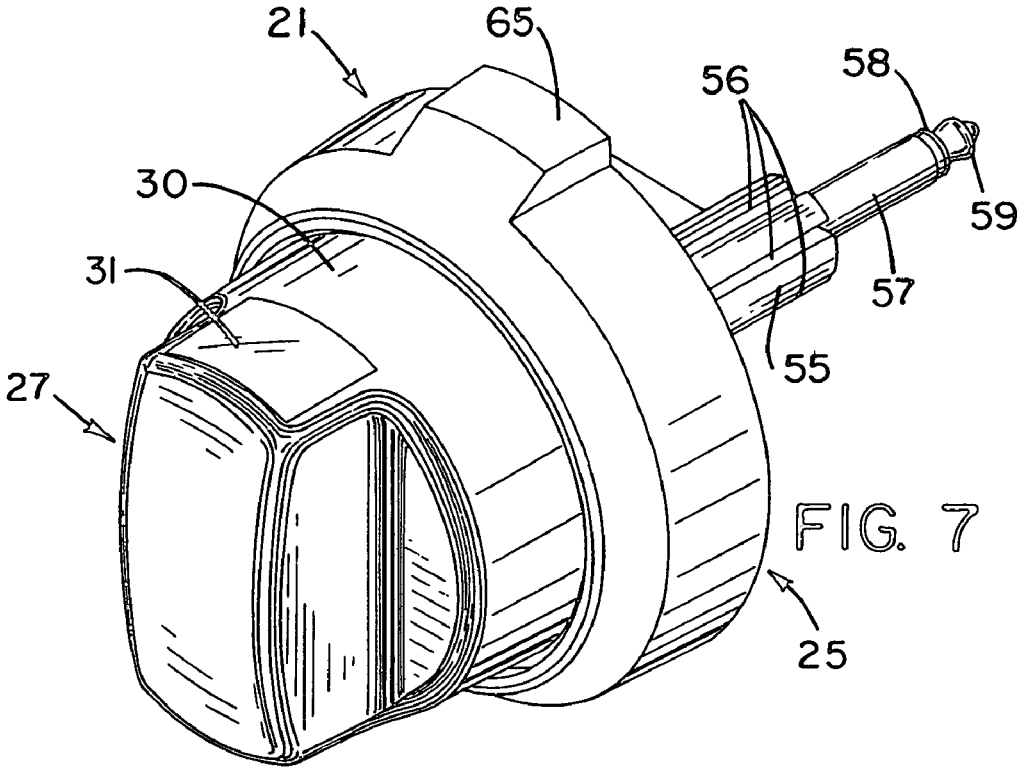
FIG. 7 is a perspective view of a preferred embodiment of a control knob and second control surface according to the invention.
Figure 8:
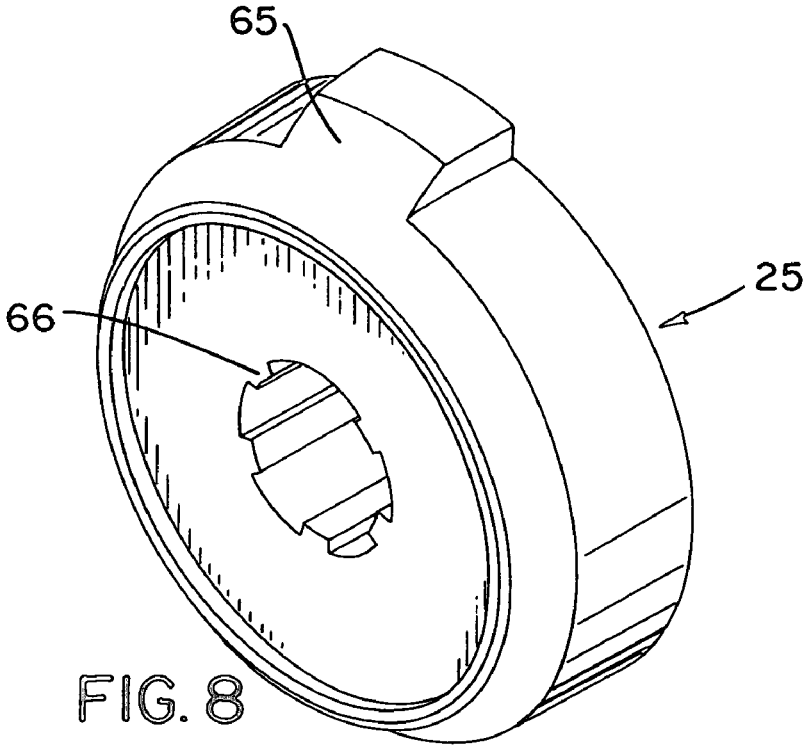
FIG. 8 is a perspective view of a preferred embodiment of a second control surface according to the invention.
Figure 9:
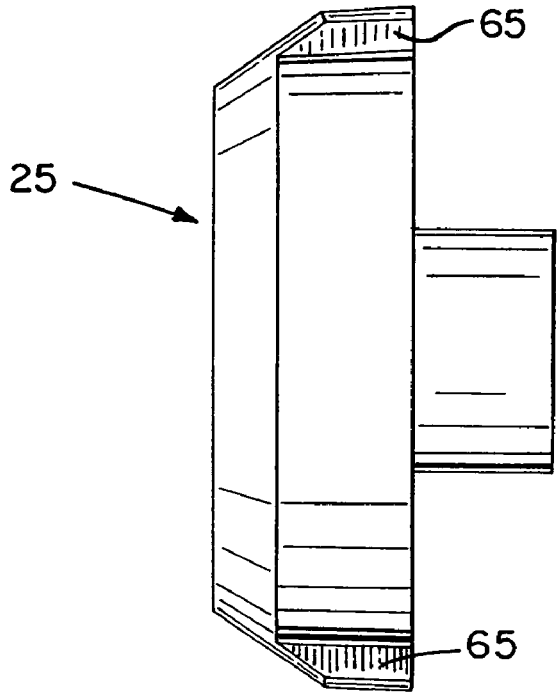
FIG. 9 is a side view of a preferred embodiment of a second control surface according to the invention.
Figure 10:
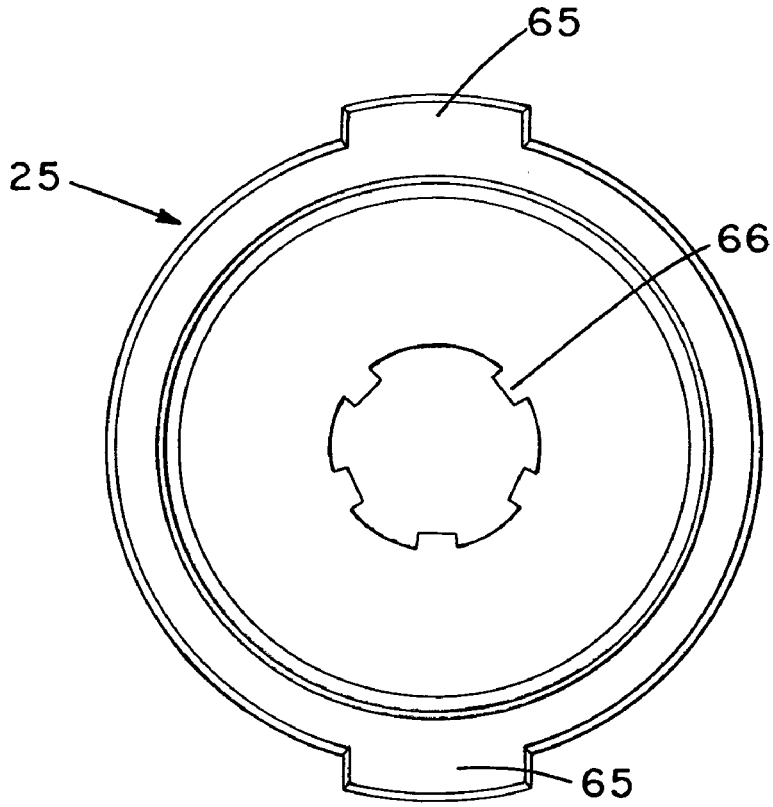
FIG. 10 is a front view of a preferred embodiment of a second control surface according to the invention.
Figure 11:
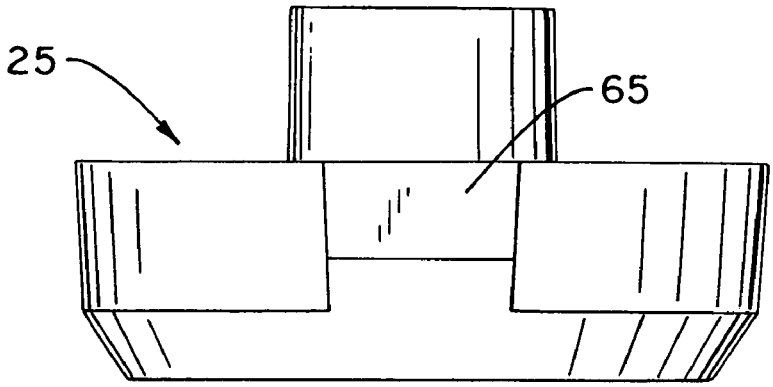
FIG. 11 is a top view of a preferred embodiment of a second control surface according to the invention.
Figure 12:
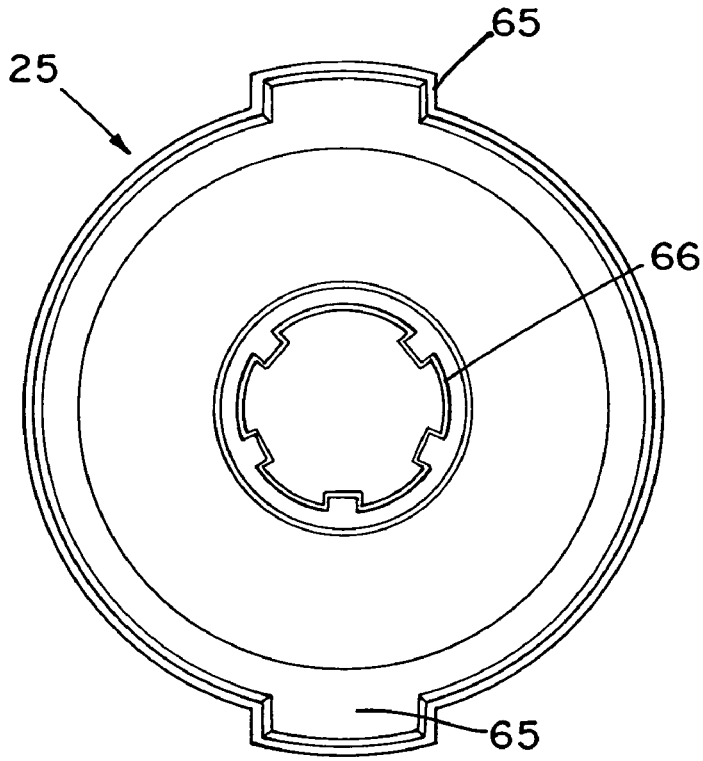
FIG. 12 is a rear view of a preferred embodiment of a second control surface according to the invention.

FIGS. 3–6 provide additional views of a preferred embodiment of a control knob 27 according to the invention. FIG. 7 provides a perspective view of a preferred embodiment of a composite control knob 21 according to the invention. FIGS. 8–12 provide additional views of a preferred embodiment of a second control surface 25 according to the invention.

Figure 13:
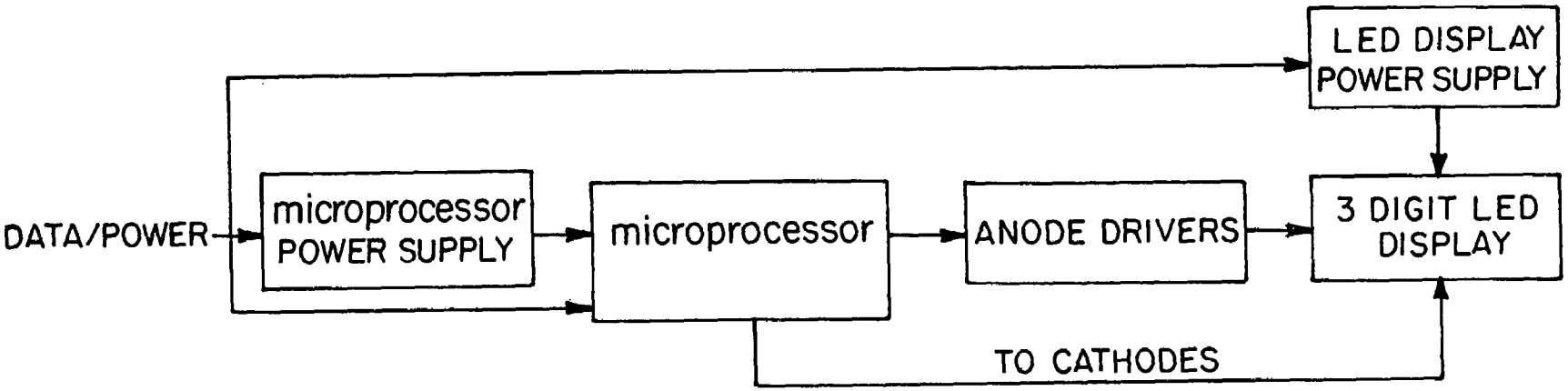
FIG. 13 is a perspective view of a preferred embodiment of a socket according to the invention.
Figure 14:
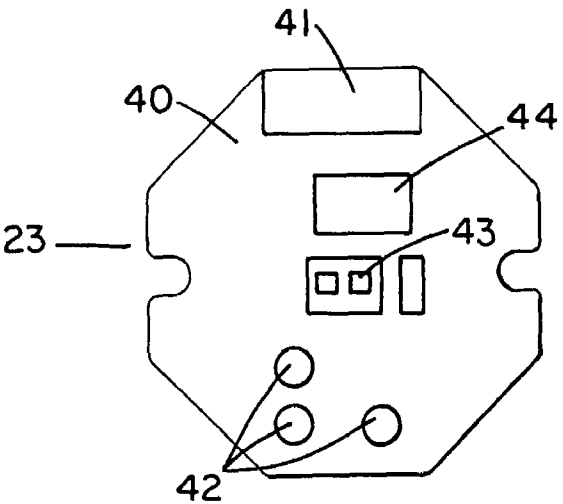
FIG. 14 is an exploded view of a preferred embodiment of a socket and a second control surface according to the invention.

FIG. 13 provides a block diagram of the electronic circuitry of a preferred embodiment of a control knob 27 according to the invention. FIG. 14 shows an exemplary layout for an electronic circuit 23 for a preferred embodiment of a control knob according to the invention.

In a preferred embodiment, a bipolar connector 60, for example a standard ¼" phone plug, carries both power and status information on the bipolar connector tip 59, with the bipolar connector sleeve 57 used as the return or ground. The signal on the bipolar connector tip 59 may carry the status information to be displayed by the knob as serial data, for example RS-232C, and also a carrier voltage, for example +5 volts DC, which may provide power for the electronic circuitry.

In a preferred embodiment, the signal on the bipolar connector tip 59 alternates between two states, a rest state and a data transmission state. During the rest state, a voltage, for example 5 volts DC, is maintained on the bipolar connector tip 59. During the data transmission state, a data transmission cycle is initiated by lowering the signal at the input to ground and then transmitting data, for example using RS-232 serial communications.

In a preferred embodiment, the voltage maintained during the rest state voltage supplies power to the electronic circuit 23. One or more capacitors 42 may be used to store charge and maintain power to the electronic circuit 23 during the data cycle. Preferably, separate capacitors may be used to provide power to the display 41 and the microprocessor 44.

In a preferred embodiment, the microprocessor 44 receives the serial data during the data transmission state, and drives the display 41, which is preferably a light emitting diode (LED) having a three digit, 7 segment display. The serial data may consist of a single numeric value for display, for example actual oven temperature, or it may consist of multiple numeric values, for example oven temperature setpoint plus actual oven temperature. The serial data may include formatting information, such as color or blinking, in addition to the numeric values.

There are various possibilities with regard to alternative embodiments and methods including a control knob according to the invention.

For example, the display 41 may produce more than one color, for example red and black, to match the color of the knob housing or for other aesthetic reasons. The display 41 may also produce more than one color, for example red and green, to indicate different status information, such as error conditions, or preheat cycle, or for other functional reasons.

Although in a preferred embodiment the rotation of the control knob may be limited to plus or minus 15 degrees, the limit of the rotation may be a lesser or greater selected number of degrees, for example plus or minus 45 degrees, without departing from the spirit of the invention.

Although in a preferred embodiment, a bipolar connector carries power and status information, other types of connectors could be used having more than two conductors. For example, a tripolar (three conductor) connector such as a stereo phone plug could be used, with one conductor for power, a second conductor for status information, and a third conductor for ground. A tripolar connector could also be used to support multiple displays within a single control knob by using, for example, one conductor for power and status to one display, a second conductor for power and status to a second display, and a third conductor for ground. A tripolar connector could also be used to support bidirectional communication between the control knob and the appliance control system, for example by using one conductor for power and status to one display, a second conductor for status or control information from the knob, and a third conductor for ground.

Although in a preferred embodiment, the control knob is sealed using washers and O-rings, this result can be accomplished with other means for sealing, for example using glue, sealing tape, tight fitting joints, foam, rubber, threads, or other materials or methods known in the art.

The display 41 may provide multiple types of information, for example oven temperature setpoint, actual oven temperature, probe setpoint, probe temperature, and error codes. The multiple types of information could be provided at the same time using non-numeric indicators, for example different colors or blinking, or by alternating between two different types of information, for example, by alternating between oven temperature setpoint and actual oven temperature.

It is understood that the invention is not confined to the embodiments set forth herein as illustrative, but embraces all such forms thereof as come within the scope of the following claims.

What is claimed is:

1. A control knob for an appliance comprising:

(a) a rotatable housing;

(b) a microprocessor within the housing;

(c) a status display within the housing; and (d) a bipolar connector wherein the bipolar connector forms an axis for rotation of the control knob;

(e) wherein display content changes relative to rotation of the housing.

2. The control knob of claim 1 wherein the rotation of the control knob is limited to less than approximately 90 degrees in either direction.

3. The control knob of claim 2 wherein the rotation of the control knob returns to a nominal centered position when the control knob is released after adjustment.

4. The control knob of claim 1 wherein the status display provides numerical values.

5. The control knob of claim 4 wherein the numerical values are representative of at least one or more of oven temperature setpoint, actual oven temperature, probe setpoint, probe temperature, or error codes.

6. The control knob of claim 1 wherein the display provides non-numeric indicators.

7. The control knob of claim 1 wherein the bipolar connector is configured to carry power and data to be displayed as display content.

8. The control knob of claim 1 wherein the connector serves as an axle for rotation of the control knob and as an electrical connector for transmission of data and power to the display.

9. The control knob of claim 1 further comprising a second control surface formed as a ring and having at least one position indicator and at least one actuator.

10. A control knob for an appliance comprising:

(a) a housing;

(b) a status display within the housing; and (c) an electrical connector forming a rotational axis for the control knob; and (d) wherein data and power are transmitted over the electrical connector;

(e) wherein display content changes based on rotation of the housing.

11. The control knob of claim 10 further comprising a second control surface.

12. The control knob of claim 10 wherein the electrical connector is a bipolar connector.

13. The control knob of claim 10 wherein the electrical connector is a tripolar connector.

14. The control knob of claim 10 wherein the rotation of the control knob is limited to less than approximately 90 degrees in either direction.

15. The control knob of claim 10 wherein the rotation of the control knob returns to a nominal centered position when the control knob is released after adjustment.

16. The control knob of claim 10 further comprising a microprocessor.

17. The control knob of claim 10 further comprising at least one capacitor.

18. The control knob of claim 10 wherein the control knob is removable from the appliance without using a tool.

19. The control knob of claim 10 further comprising sealing means whereby the control knob housing is sealed.

20. The control knob of claim 10 wherein the status display is a light emitting diode.

21. The control knob of claim 20 wherein the light emitting diode is capable of displaying more than one color.

22. A method of controlling an appliance comprising:

(a) providing a control knob having a housing, a microprocessor and a status display within the housing, a shaft assembly, and an electrical connector that forms an axis of rotation for the control knob;

(b) providing a socket having a shaft assembly receiver;

(c) inserting the shaft assembly into the socket;

(d) transmitting status information on the electrical connector;

(e) receiving the status information; and (f) displaying the status information on the status display;

(g) changing information on the status display by rotating the control knob.

23. The method of claim 22 further comprising detecting the presence or absence of the shaft assembly in the socket, and disabling the appliance if the shaft assembly is absent.

24. The method of claim 22 further comprising removing the control knob from the appliance, cleaning the control knob, and replacing the control knob on the appliance.

25. The method of claim 22 wherein the status information is transmitted serially.

26. The method of claim 22 further comprising supplying power to the microprocessor on the electrical connector.

27. The method of claim 22 further comprising limiting the rotation of the control knob to less than approximately 90 degrees in either direction.

28. The method of claim 22 further comprising removing the control knob from the appliance without using a tool, cleaning the control knob, and replacing the control knob on the appliance without using a tool.

29. The method of claim 22 wherein status information is displayed on the status display using more than one color.

* * * * *

UNITED STATES PATENT AND TRADEMARK OFFICE

CERTIFICATE OF CORRECTION

PATENT NO. : 7,171,727 B2
APPLICATION NO. : 10/265219
DATED : February 6, 2007
INVENTOR(S) : Brian D. Wylie et al.

It is certified that error appears in the above-identified patent and that said Letters Patent is hereby corrected as shown below:

Col. 6, line 3, Claim 10:

In subsection (c), delete the word "and" after "control knob;".

Signed and Sealed this

First Day of April, 2008

JON W. DUDAS
*Director of the United States Patent and Trademark Office*